US006708425B2

(12) United States Patent
Parisotto

(10) Patent No.: US 6,708,425 B2
(45) Date of Patent: Mar. 23, 2004

(54) SKI BOOT

(75) Inventor: Davide Parisotto, Casella d'Asolo (IT)

(73) Assignee: Calzaturificio S.C.A.R.P.A. S.p.A., Viale Tiziano (IT)

( * ) Notice: Subject to any disclaimer, the term of this patent is extended or adjusted under 35 U.S.C. 154(b) by 0 days.

(21) Appl. No.: 10/051,443

(22) Filed: Jan. 18, 2002

(65) Prior Publication Data

US 2002/0112377 A1 Aug. 22, 2002

(30) Foreign Application Priority Data

Jan. 22, 2001 (EP) ..... 01830033

(51) Int. Cl.[7] ..... A43B 5/04

(52) U.S. Cl. ..... 36/118.2; 36/117.2; 36/117.4; 36/118.9

(58) Field of Search ..... 36/118.2, 118.7, 36/118.3, 118.4, 118.9, 119.1, 117.2, 117.4

(56) References Cited

U.S. PATENT DOCUMENTS 4,138,828 A * 2/1979 Kubelka ..... 36/117.1
4,800,658 A 1/1989 Zanatta
4,945,660 A * 8/1990 Perrissoud ..... 36/117.1
5,136,794 A * 8/1992 Stamoacchia et al. ..... 36/117.1
5,526,587 A * 6/1996 Sartor ..... 36/117.1
5,815,953 A * 10/1998 Kaufman et al. ..... 36/118.3
5,915,821 A * 6/1999 Okajima et al. ..... 36/117.1
6,012,237 A * 1/2000 Okajima et al. ..... 36/118.2
6,247,252 B1 * 6/2001 Parisotto ..... 36/118.7
6,530,161 B1 * 3/2003 Bauvois ..... 36/118.4

FOREIGN PATENT DOCUMENTS

CZ 549970 4/1974

* cited by examiner

*Primary Examiner*—Anthony D. Stashick
(74) *Attorney, Agent, or Firm*—Kenneth L. Sherman, Esq.; Myers Dawes Andras & Sherman; Vic Y. Lin, Esq.

(57) ABSTRACT

A ski boot, in particular a ski-mountaineering or telemark boot, having a shell made of plastic material; a shank hinged to the shell; and a control mechanism, located at the rear portion of the boot, for controlling the tilt of the shank and having a lever hinged to a projection of the shank and movable between a work position in which one end cooperates with a rear projection of the shell to prevent rearward rotation of the shank, and a release position. The control mechanism has a ring hinged to the lever and engaging a recess formed in the rear projection of the shell to also prevent forward rotation of the shank with respect to the shell.

7 Claims, 2 Drawing Sheets

SKI BOOT

The present invention relates to a ski boot, in particular for ski-mountaineering or telemark

BACKGROUND OF THE INVENTION

Ski-mountaineering boots are known to comprise a shell made of plastic material, a sole, and a shank hinged to the shell at the ankle.

Ski-mountaineering calls for boots capable of assuming a downhill position, in which, as with downhill ski boots, both the toe and heel portions of the boot are clamped to the ski and the shank of the boot is fixed rigidly to the shell, and an uphill or walking position, in which only the toe portion of the boot is clamped and the heel portion is free, i.e. raised off the ski, to enable the ski to be dragged as in cross-country skiing A major drawback of this type of boot lies in it allowing of no change in position when skiing downhill in soft snow.

By way of a solution to the problem, ski-mountaineering boots have been proposed comprising a mechanism by which to rotate the shank forwards when moving diagonally downhill, so that the user's weight is shifted forwards, and to prevent rearward rotation of the shank with respect to the shell to prevent an excessively rearward position when turning.

Boots of this sort, however, are not rigid enough for downhill skiing on hard snow or ski tracks, by even the slightest rotation of the shank with respect to the shell making it difficult to control the ski and increasing the risk of injury.

Telemark skiing poses similar problems by calling for turning with the heel raised off the ski, as opposed to clamped rigidly as in conventional skiing. Known boots are normally capable of assuming an uphill or walking position without the ski, in which the shank is free to rotate forwards and rearwards with respect to the shell, and a downhill position in which the shank is locked; while other known models enable the shank to rotate slightly forwards with respect to the shell.

Boots of this sort therefore also fail to provide for all-round performance by being designed for specific types of snow.

SUMMARY OF THE INVENTION

It is an object of the present invention to provide a plastic ski boot, in particular a ski-mountaineering or telemark boot, designed to solve the aforementioned problems typically associated with known boots.

According to the prevent invention, there is provided a ski boot, in particular a ski-mountaineering or telemark boot, comprising a shell made of plastic material and having a bottom wall, two lateral walls and a toe portion; a shank hinged to said shell; and a control mechanism, located at the rear portion of the boot, for controlling the tilt of the shank with respect to the shell and comprising:

a first retaining portion and a second retaining portion, one of which is integral with said shell, and the other with said shank; and a lever member hinged to said first retaining portion, said lever member being movable between a work position wherein one end rests on said second retaining portion to prevent rearward rotation of said shank, and a release position;

characterized in that said control mechanism comprises a third retaining portion integral with said second retaining portion; and an auxiliary locking member movable between a lock position connecting said lever member to said third retaining portion, and a rest position

BRIEF DESCRIPTION OF THE DRAWINGS

A preferred, non-limiting embodiment of the present invention will be described by way of example with reference to the accompanying drawings, in which.

DETAILED DESCRIPTION OF THE INVENTION

Figure 1:
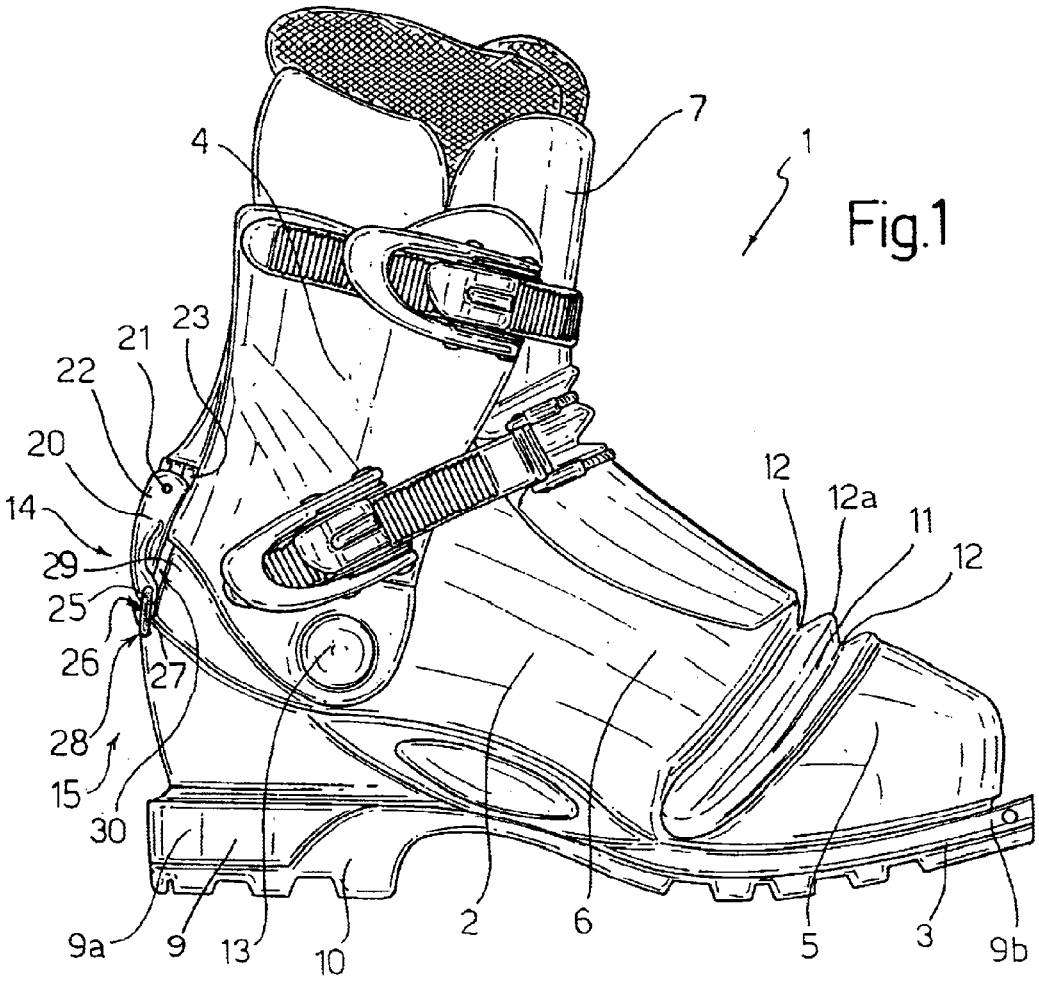
FIG. 1 shows a side view of a ski boot in accordance with the present invention.
Figure 2:
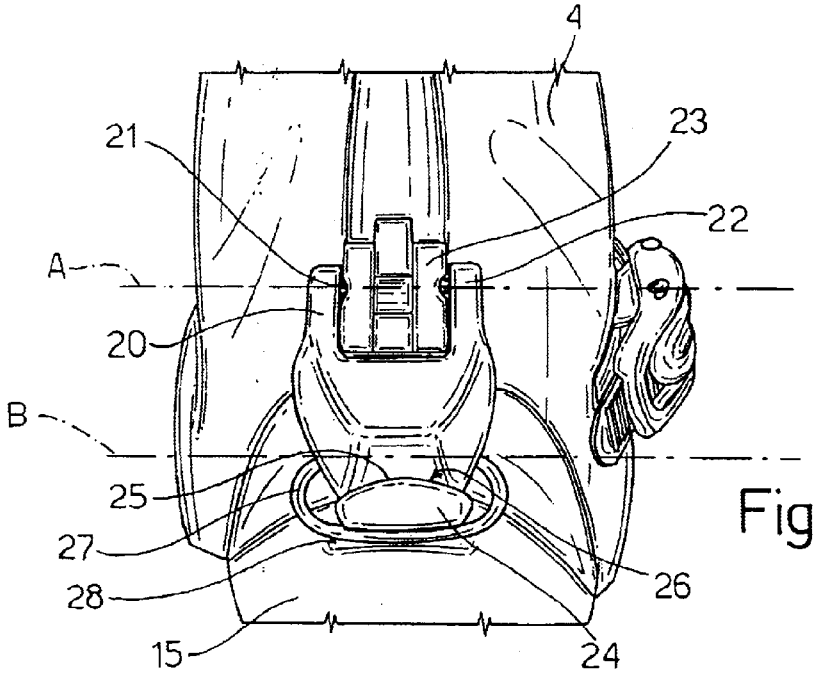
FIG. 2 shows a partial rear view of the FIG. 1 boot with the tilt control mechanism in a first position.

Number 1 in FIG. 1 indicates as a whole a ski boot, in particular a ski-mountaineering boot.

Boot 1 substantially comprises a shell 2 made of plastic material; a sole 3; and a shank 4 hinged to shell 2 at the ankle.

Shell 2 (FIG. 1) comprises integrally a toe portion 5; two lateral walls 6 forming a front opening (not shown) closed by a known tongue 7; and a bottom wall or inner sole 9 closing the bottom of their shell and forming a heel portion 9*a* in relief. Inner sole 9 also forms a toe flange 9*b* projecting from toe portion 5 and cooperating in known manner with a clamp on the ski (not shown). An outer sole 10 made of elastomeric material is fixed to the bottom of inner sole 9 and forms, with inner sole 9, sole 3.

Shell 2 also comprises a flexible portion 11 extending crosswise with respect to the shell, from one side to the other of sole 3, and substantially located at the metatarsus of the wearer, i.e. close to the toe portion 5 of shell 2.

Flexible portion 11 has an undulated contour defined by two grooves 12 separated by a radiused intermediate portion 12*a,* conveniently extends obliquely to follow the natural bend axis of the foot, and has one end, on the inner side of boot 1, located forwards with respect to the other end on the outer side of boot 1.

Shank 4 is connected to lateral walls 6 of shell 2 by respective hinges 13 along the transverse hinge axis of the ankle; and boot 1 comprises a control mechanism 14 for controlling the tilt of shank 4 with respect to shell 2 and located at a rear portion 15 of the boot, substantially above the heel.

Tilt control mechanism 14 comprises a lever 20 having a first end 22 hinged to a first retaining portion, defined by a rear projection 23 of shank 4, by a pin 21 having a horizontal axis A crosswise with respect to boot 1.

Shell 2 of boot 1 comprises a rear projection 24 spaced apart from and below projection 23 of shank 4. Projection 24 is defined by a top surface 26 facing lever 20, and has a rear surface with a substantially horizontal recess 28 for the purpose explained in detail later on.

Lever 20 is movable between a lowered work position (FIG. 1) wherein a second end 25 of lever 20 rests against top surface 26 of projection 24 to prevent shank 4 from rotating rearwards with respect to shell 2, and a raised or rest position (FIG. 5) wherein shank 4 is fully released from shell 2.

Control mechanism 14 also comprises a horizontally elongated metal ring 27, a substantially horizontal portion (not shown) of which is housed inside a transverse through hole formed in second end 25 of lever 20, so as to hinge ring 27 to lever 20 about an axis B parallel to axis A.

When lever 20 is in the work position, ring 27 can be set to a lock position engaging recess 28 to also prevent forward rotation of shank 4 with respect to shell 2.

Shell 2 has a recessed rear portion 29 facing lever 20 and forming a cavity 30 with lever 20 in the work position.

Figure 5:
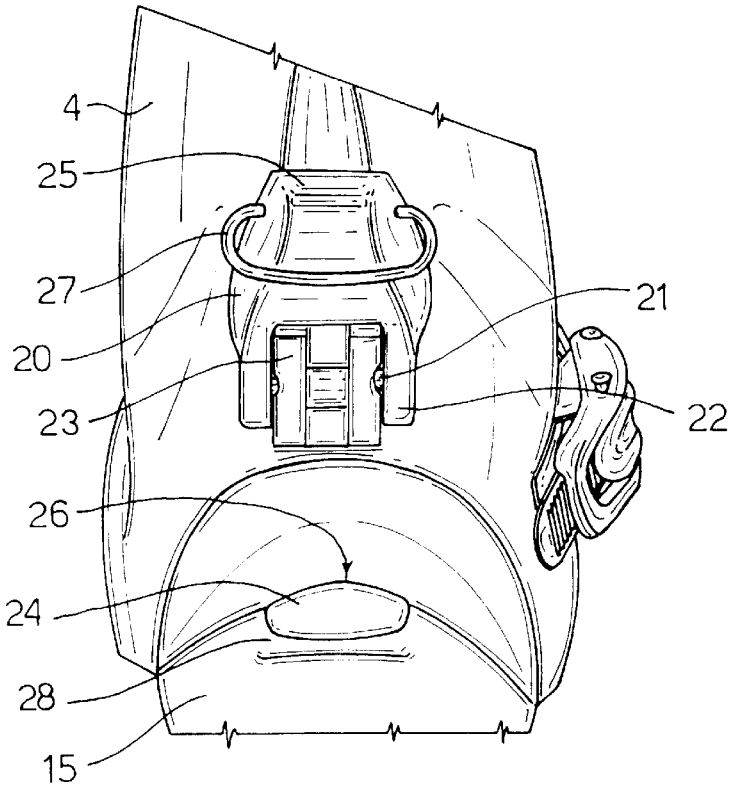
FIG. 5 shows a partial rear view of the FIG. 2 boot with the tilt control mechanism in a third position.

In actual use, when ring 27 is released from recess 28, lever 20 can be rotated about axis A from the FIG. 1 work position to the FIG. 5 raised position also permitting rearward rotation of shank 4 with respect to shell 2. This position is conveniently used when climbing or walking.

Figure 3:
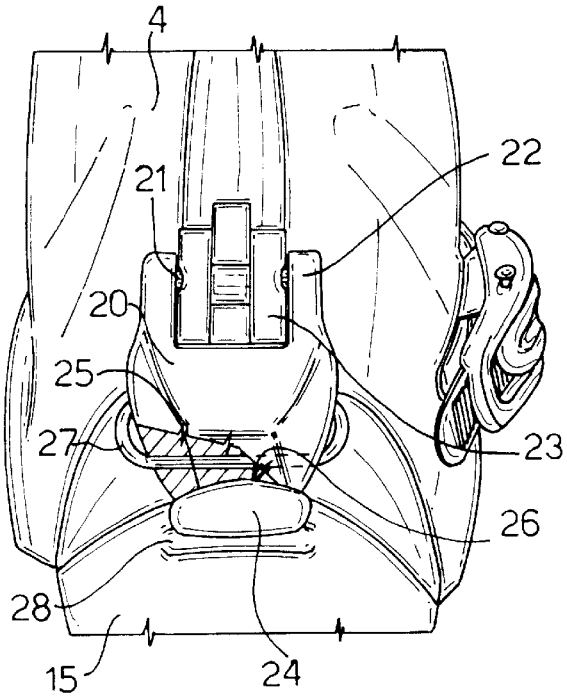
FIG. 3 shows a partial rear view of the FIG. 1 boot with the tilt control mechanism in a second position.
Figure 4:
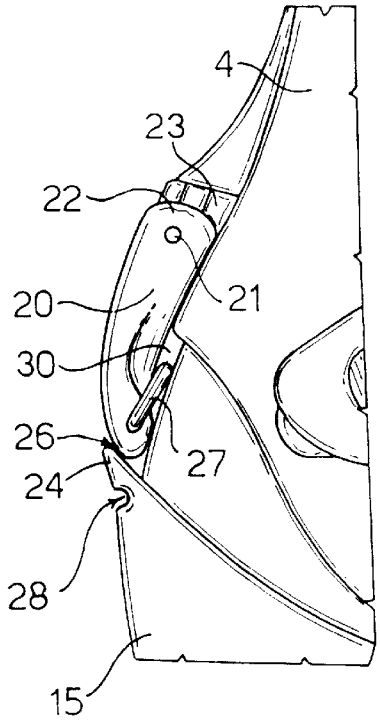
FIG. 4 shows a partial side view of the FIG. 1 boot with the tilt control mechanism in a second position.

When lever 20 is in the work position, end 25 rests on top surface 26 of rear projection 24, as described above, to prevent rearward rotation of shank 4, and ring 27 can be set either to the work position described above, or to a rest position stowed safely out of the way inside cavity 30, as shown in FIGS. 3 and 4.

The FIGS. 3 and 4 position only prevents rearward rotation of shank 4, and is therefore useful when skiing downhill in soft snow; whereas the FIG. 1 position (lever 20 in the work position and ring 27 in the lock position) prevents any rotation of shank 4 with respect to shell 2, and is therefore particularly useful when skiing downhill on hard snow or ski tracks.

The advantages of the boot according to the present invention will be clear from the foregoing description.

In particular, the mechanism for controlling the tilt of the shank with respect to the shell provides for adapting retention of the shank to different operating conditions and types of snow, so that the boot is more versatile by not being subject to the design limitations typical of known boots.

Moreover, ring 27 is protected against impact or entanglement by being stowable safely inside a cavity 30 between shell 2 and shank 4.

Clearly, changes may be made to boot 1 as described herein without, however, departing from the scope of the accompanying Claims.

In particular, lever 20 may be hinged to a first retaining portion integral with shell 2, as opposed to shank 4, and may cooperate with a second retaining portion integral with shank 4; and ring 27 may be replaced by any selectively activated auxiliary locking member between the lever and a third retaining portion integral with the second retaining portion.

What is claimed is:

1. A ski boot, in particular a ski-mountaineering or telemark boot, comprising a shell (2) made of plastic material and having a bottom wall (9), two lateral walls (6) and a toe portion (5); a shank (4) hinged to said shell; and a control mechanism (14), located at the rear portion (15) of the boot, for controlling the tilt of the shank with respect to the shell and comprising:

a first retaining portion (23) and a second retaining portion (24), one of which is integral with said shell (2), and the other with said shank (4); and a lever member (20) hinged to said first retaining portion (23), said lever member (20) being movable between a work position wherein one end (25) rests on said second retaining portion (24) to prevent rearward rotation of said shank (4), and a release position;

characterized in that said control mechanism (14) comprises a third retaining portion (28) integral with said second retaining portion (24); and an auxiliary locking member (27) movable at least between a lock position connecting said lever member (20) to said third retaining portion (28), and a rest position, and characterized in that said auxiliary locking member (27) is carried by said lever member (20).

2. A boot as claimed in claim 1, characterized in that said first retaining portion (23) is integral with said shank (4), and said second retaining portion (24) is integral with said shell (2).

3. A boot as claimed in claim 2, characterized in that said first retaining portion (23) is defined by a rear projection (23) of the shank (4); and said second retaining portion (24) is defined by a rear projection (24) of said shell (2) defined by a top surface (26) facing said lever member (20).

4. A boot as claimed in claim 1, characterized in that said auxiliary locking member (27) is hinged to said lever member (20).

5. A boot as claimed in claim 4, characterized in that said auxiliary locking member (27) is defined by a metal ring (27).

6. A boot as claimed in claim 5, characterized in that said third retaining portion (28) is defined by a seat (28) formed in said rear projection (23) of the shell and for receiving said ring (27) in said lock position.

7. A boot as claimed in claim 6, characterized in that said shell (2) and said lever member (20) in said work position define a cavity (30) for receiving said auxiliary locking member (27) in said rest position.

* * * * *